US006237260B1

(12) United States Patent
Gooch

(10) Patent No.: US 6,237,260 B1
(45) Date of Patent: May 29, 2001

(54) DRAGLINE BUCKET WITH QUICK CHANGE BASKET FEATURE

(75) Inventor: James E. Gooch, Providence, KY (US)

(73) Assignee: West Kentucky Steel Construction Company, Inc., Providence, KY (US)

( * ) Notice: Subject to any disclaimer, the term of this patent is extended or adjusted under 35 U.S.C. 154(b) by 0 days.

(21) Appl. No.: 09/472,103

(22) Filed: Dec. 27, 1999

Related U.S. Application Data

(60) Provisional application No. 60/114,041, filed on Dec. 28, 1998.

(51) Int. Cl.[7] ..... E02F 3/60
(52) U.S. Cl. ..... 37/398; 37/403
(58) Field of Search ..... 37/394, 398, 368, 37/423

(56) References Cited

U.S. PATENT DOCUMENTS

| | | | |
|---|---|---|---|
| 1,879,447 | * | 9/1932 | Page . |
| 1,908,686 | | 5/1933 | Burke . |
| 2,584,416 | | 2/1952 | Boehringer . |
| 2,597,711 | | 5/1952 | Donald . |
| 2,895,239 | * | 7/1959 | Larsen . |
| 2,911,120 | | 11/1959 | Reinhardt et al. . |
| 4,550,512 | * | 11/1985 | Feistet . |
| 4,944,102 | | 7/1990 | Behlendorf et al. . |
| 5,307,571 | | 5/1994 | Behlendorf et al. . |
| 6,098,321 | * | 8/2000 | Logan . |

* cited by examiner

*Primary Examiner*—H. Shackelford
(74) *Attorney, Agent, or Firm*—King and Schickli, PLLC

(57) ABSTRACT

A dragline bucket includes a forward ring that is releasably connected to a basket. The forward ring includes an arch, a first cheek plate, a second cheek plate, and a bottom wall carrying excavation teeth. The basket includes first and second sidewalls and a lower wall. The walls cooperate to receive and hold the material won during the mining or excavation operation. Releasable fasteners secure portions of the basket in receiving means formed in the forward ring, thereby permitting relatively quick and easy separation of the components for repair or replacement.

13 Claims, 2 Drawing Sheets

DRAGLINE BUCKET WITH QUICK CHANGE BASKET FEATURE

This application claims the benefit of U.S. Provisional Patent Application Ser. No. 60/114,041, filed Dec. 28, 1998.

TECHNICAL FIELD

The present invention relates generally to the mining and material excavation arts and, more particularly, to a dragline bucket wherein the basket is releasably secured to the forward ring.

BACKGROUND OF THE INVENTION

Dragline buckets are commonly used as an effective means of excavating overburden and winning coal during surface mining operations. Examples of common types of prior art dragline buckets can be found in U.S. Pat. Nos. 5,575,092 to Smit, 5,307,571 and 4,944,102, both to Behlendorf et al., as well as in now expired U.S. Pat. Nos. 2,584,416 to Boehringer and 1,908,686 to Burke. Each of these dragline buckets generally include a front, or forward, ring-like portion having a plurality of teeth for digging into the ground and a rear, basket-like portion for holding the excavated materials. Typically, the two components are joined to form a unitary bucket using welds, rivets, or other substantially permanent joining techniques. This creates a long lasting, durable bond that ensures that the unitary bucket can withstand the rigors of the excavation process without the components detaching from each other.

While a dragline bucket of unitary construction is effective for its intended purpose, it does suffer from one very significant shortcoming. Specifically, in a dragline bucket of unitary construction, it is difficult to separate the forward ring from the basket in the event that damage occurs to either component during extensive excavation operations, or if one of the components fulfills its useful life prior to the exhaustion of the full service life of the opposite component. In the past, extensive metalworking processes, such as cutting welds or removing a plurality of rivets, have been required to separate the components. It should be appreciated that such operations are very labor intensive and time consuming. This is particularly evident when one considers the size of a typical dragline bucket which has a capacity on the order of 220 cubic yards or more. In many situations, this can lead to significant production downtime for the dragline operation.

Another difficulty with prior art buckets is that the forward ring and basket are commonly made of very thick and heavy sections of durable metal materials, such as steel. Of course, the goal in using such materials is to prolong the service life of the individual components. This is a primary concern when one considers the previously described difficulty encountered when repairing and maintaining a bucket of unitary construction. The use of heavy metal materials, however, is not without its deletarious side effects.

Specifically, these materials greatly increase the weight of the bucket. Of course, the greater the weight of the bucket, the less the weight of material that may be removed by a dragline of given power (i.e. a larger portion of the lifting capacity of the dragline is used to lift the bucket and as a consequence there is less capacity available for lifting material).

If the basket could be easily replaced, it would be possible to use thinner and/or lighter construction materials since component service life would not be the primary design consideration it is at present. When lighter materials are used in the construction of the bucket, a larger portion of the lifting capacity of the dragline is available to lift material won during the mining operation. As such, more material may be won in each pass of the bucket and overall mining efficiency may be greatly enhanced.

Thus, a need is identified for a dragline bucket that overcomes the above-described limitations of the prior art. The bucket would have a basket that is secured to a forward ring in a manner that allows for easy removal and replacement. In addition to improving the efficiency of the repair operation, the simplicity and ease of replacement would permit the use of thinner materials of less overall weight in fabricating the basket. Overall, the improved dragline bucket would result in a significant improvement over baskets formed as a unitary whole using welding, rivets, or other permanent joining techniques.

SUMMARY OF THE INVENTION

Accordingly, it is a primary object of the present invention to provide a dragline bucket having a basket that is releasably secured to the forward ring to permit the quick and efficient (1) attachment of the components to form the bucket, and (2) detachment of the components in the event repair or replacement of any component becomes necessary.

Another object of the present invention is to provide a dragline bucket that avoids the use of welds, rivets, or other types of permanent joining techniques to secure the forward ring to the basket, thereby facilitating the separation of the components forming the bucket for repair or replacement.

Still another object of the present invention is to provide a improved dragline bucket wherein the ease and efficiency of detachment of the releasable forward ring from the basket permits the use of thinner, less durable and, therefore, more light weight materials in fabricating the basket component.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved dragline bucket is provided with a quick change basket. Advantageously, the quick change feature allows for the easy removal of the basket or forward ring if either is damaged during operation or otherwise in need of repair. Another advantage provided by this improvement feature is that the basket component may be fabricated of thinner materials, if desired, thereby resulting in a lighter bucket that effectively reserves a greater proportion of the crane's lifting capacity for the stripping of overburden. This improves the overall efficiency of the excavating operation.

In the preferred embodiment, the dragline bucket includes a forward ring having an arch, a first cheek plate, a second cheek plate, and a bottom wall. Each of the components are joined together using any suitable metal joining techniques, such as by welding. The bottom wall of the forward ring carries a plurality of forwardly projecting teeth for digging into the material being excavated, such as the overburden in a surface mining operation.

The dragline bucket also includes a basket portion. The basket has an open front end and includes a lower wall, a pair of opposed sidewalls, and a rear wall. These walls cooperate to receive and hold the material won during the mining or excavation process.

The cheek plates carry means for receiving the forward margins of the sidewalls of the basket. In the preferred embodiment, the receiving means take the form of one or more pairs of mounting lugs projecting rearwardly from each cheek plate. Each pair of mounting lugs are provided with corresponding apertures. The lug pairs each form a channel for receiving the corresponding portion of the basket sidewall.

In accordance with an important aspect of the invention, the lug pairs on the forward ring allow for the quick attachment and detachment of the basket therefrom. To make the connection between the two components, a mounting lip on the bottom wall of the forward ring is placed in lapping relationship with a forward margin of the lower wall of the basket. The lip and forward margin of the lower wall have corresponding apertures through which releasable fasteners, such as mounting pins or bolts are inserted and locked in place. To complete the connection, the forward margins of the sidewalls are placed between the mounting lugs of the forward ring until apertures formed therein align and register with apertures formed in the reinforced portions of the sidewalls of the basket. Releasable fasteners, such as pins or bolts, are then inserted through the aligned apertures and secured in place using nuts or similar locking means. In the preferred embodiment, the forward margins of the sidewalls are reinforced to provide added strength and assist in preventing the pins or bolts from tearing through the apertures.

As should now be appreciated, the connection is completed without resort to welding or other permanent metal joining processes. Advantageously, this permits the easy and efficient detachment/separation of the forward ring from the basket for repair or replacement in the event of damage or extreme wear. Yet another advantage of the proposed invention is that unlike prior art unitary dragline buckets where separation requires extensive metal cutting or the removal of a number of rivets, the quick release feature allows for the use of less heavy materials to form the basket and forward ring. This is because if either component is damaged, it can be easily and efficiently removed for repair and, if necessary, replaced in many cases on site with minimal effort.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description which follows, serve to explain the principles of the invention. In the drawings.

Reference will now be made in detail to the present preferred embodiment of the invention, an example of which is illustrated in the accompanying drawings.

DETAILED DESCRIPTION OF THE INVENTION

Figure 1:
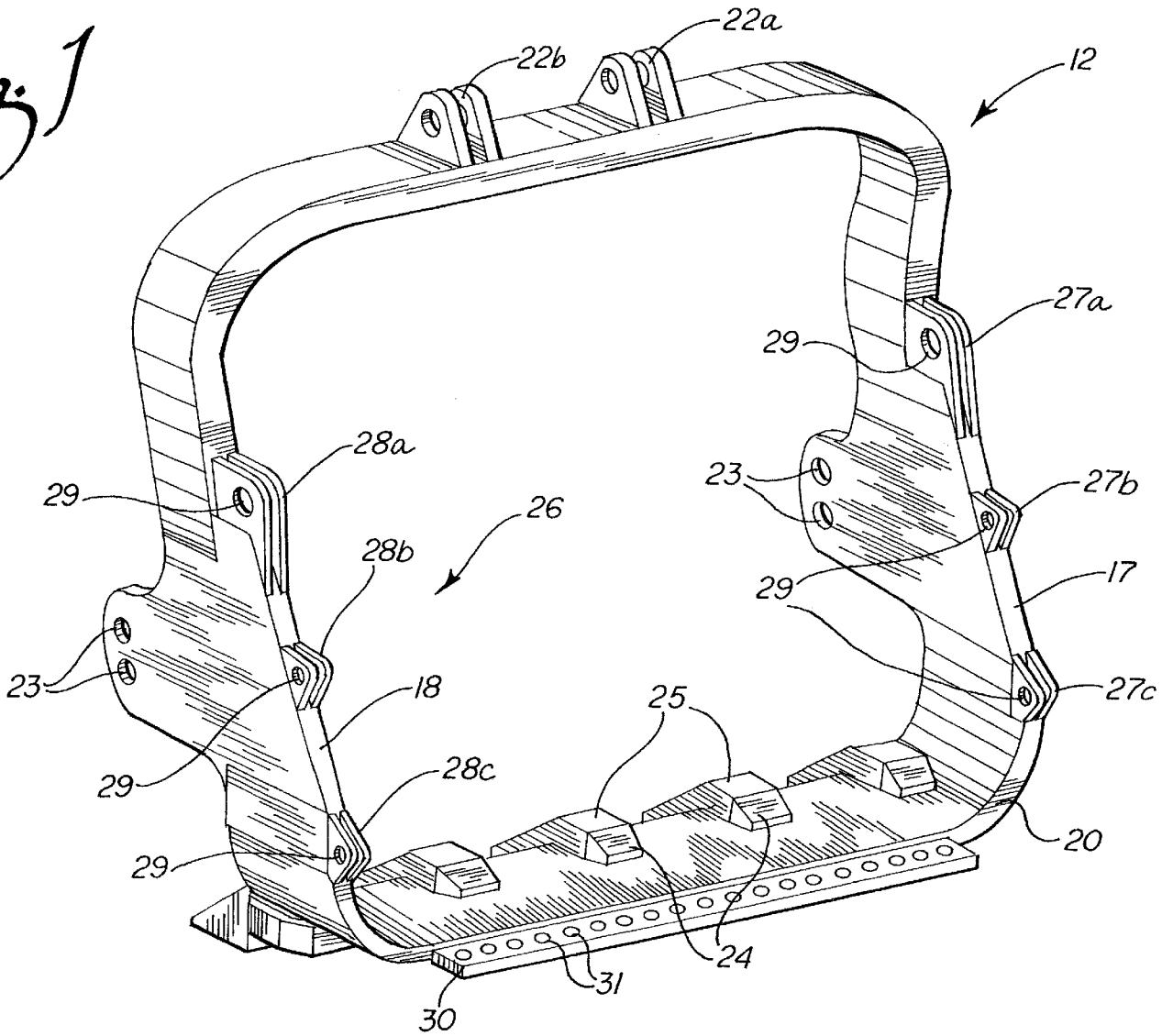
FIG. 1 is a rear perspective view of the forward ring of the dragline bucket of the present invention illustrating in particular the cooperating pairs of mounting lugs for receiving the reinforced forward margins of the sidewalls of the basket and the lower mounting lip projecting rearwardly from the bottom wall of the ring for engaging with the forward margin of the lower wall of the basket in a lapping relationship.
Figure 2:
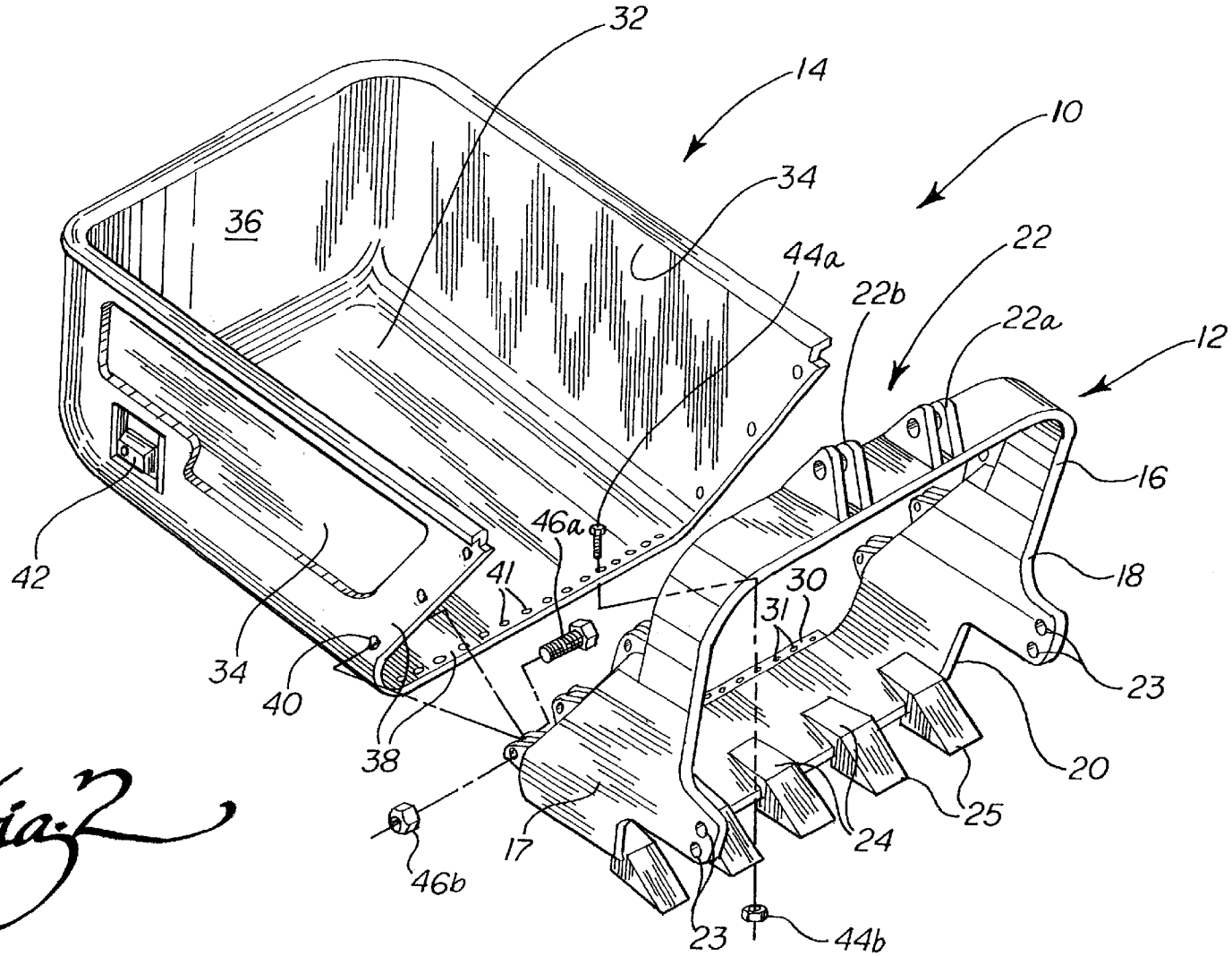
FIG. 2 is an exploded view of the dragline bucket of the present invention, including the releasable fasteners that are used to secure the forward ring to the basket along the side and lower walls thereof.

Reference is now made to FIGS. 1 and 2 illustrating the preferred embodiment of the improved dragline bucket 10 of the present invention (FIG. 2) and a rear perspective view of the forward ring 12 (FIG. 1). The dragline bucket 10 of the type shown is intended primarily for use with a crane or similar structure. In operation, a plurality of cables are used to drag the bucket 10 across the ground and excavate the desired material. The cables are then used to lift and move the bucket to a location suitable for dumping the material gathered during the dragging step. More particularly, and as is described in further detail below, the bucket 10 is connected to hoist, dump and drag cables (not shown) extending from the boom of a crane (also not shown) in a manner well known to those skilled in the dragline art.

As best illustrated in FIG. 2, the bucket 10 includes a forward ring 12 and a basket 14. The forward ring 12 includes an arch 16, first and second side cheek plates 17, 18 and a bottom wall 20. The terminal ends of the arch 16 are joined to the top portions of the cheek plates 17, 18 using weldments or any type of well known metal joining techniques known to be suitable for this purpose. Mounting trunnions 22 in the form of corresponding lug pairs 22*a*, 22*b* are positioned atop the arch 16 for receiving the dump chain/cable that in part serves to raise and lower the front end of the bucket 10 during operation to permit the contents of the basket 14 to be dumped. Additionally, one or more mounting apertures 23 are formed in a forwardly projecting portion of the cheek plates 17, 18 for receiving the drag chain/cable (not shown).

The bottom wall 20 of the forward ring is attached to a lower portion of the respective cheek plate 17, 18 using weldments or the like. The bottom wall 20 carries a plurality of buttresses 24 that receive forwardly projecting teeth 25 for digging into the material being excavated. As is known in the art, these teeth 25 are preferably releasably secured in and to the buttresses 24. This allows for the replacement of the teeth 25 in the event of excessive wear or damage.

Both cheek plates 17, 18 carry means for receiving a portion of the basket 14. In the preferred embodiment, the receiving means 26 take the form of first through sixth pairs of corresponding mounting lugs 27*a*, 27*b*, 27*c* and 28*a*, 28*b*, 28*c*. Each pair of lugs 27*a–c*, 28*a–c* form a channel for receiving the forward side margins of the basket 14, as described further below. The first 27*a* and second 28*a* lug pairs are positioned near the top of the rear side edges of the respective cheek plates 17, 18; the third 27*b* and fourth 28*b* lug pairs are positioned at the bottom, and the fifth 27*b* and sixth 27*c* lug pairs are positioned in the middle. Each pair of lugs 27*a–c* and 28*a–c* have corresponding aligned apertures formed therein, collectively noted by reference numeral 29.

In addition to the mounting lugs 27*a–c* and 28*a–c*, a mounting lip 30 projects rearwardly from the bottom wall 20 of the forward ring 12 (see FIG. 1). The mounting lip 30 is provided with a plurality of apertures 31 for receiving releasable fasteners, as is also described further below. The plates which form the lugs 27*a–c* and 28*a–c* and the mounting lip 30 are preferably welded to the cheek plates 17, 18 and bottom wall 20 of the forward ring 12, respectively.

The basket portion 14 includes a lower wall 32, a pair of opposing sidewalls 34, and a rear wall 36. These walls 32, 34, 36 cooperate to receive and hold the material won during the mining or excavation process. The basket 14 includes a reinforced forward margin 38 extending at least along the front portions of both of the sidewalls 34, and preferably along the lower wall 32 also. Apertures 40 formed at spaced locations along the reinforced portions of the sidewalls 34 correspond with the apertures 29 formed in the pairs of mounting lugs 27*a–c* and 28*a–c*. The lower wall 32 is provided with a plurality of apertures 41 along the forward margin for corresponding with apertures 31 formed in the mounting lip 30. Trunnion brackets 42 are formed along the outside of both sidewalls 34 for receiving the hoist chains/cables from the boom (not shown). To permit attachment of the hoist chains/cables to the trunnion brackets 42, a spreader bar (not shown) of a type known in the art may be used.

The process of connecting the components to form the dragline bucket 10 will now be described in detail. The mounting lip 30 of the forward ring 12 is placed on the forward margin of the lower wall 32 of the basket 14 in a lapping relationship such that the apertures 31, 41 formed therein align and register. Releasable fasteners 44*a*, such as bolts, are then inserted through the registering apertures and locked in place using nuts 44*b* or the like. To complete the connection, the basket 14 is urged toward the forward ring 12 such that portions of the forward reinforced margins 38 of the sidewalls 34 are in the channels formed between the pairs of mounting lugs 27*a–b*, 28*a–c* projecting rearwardly from the forward ring 12. Upon alignment of the apertures 40 of sidewalls 34 with the apertures 29 formed in the respective lug pairs 27*a–c*, 28*a–c*, releasable fasteners 46*a*, such as bolts or locking pins, are inserted through the aligned apertures and secured in place using nuts 46*b* or the like. Upon connection of the hoist, dump and drag chains/cables (not shown) to the respective connections 22, 23, 42, the excavation operation is ready to begin.

In the past, basket repair and/or replacement involved extensive metal working including the cutting of old welds and/or the removal of rivets. As such, repair and replacement procedures were complicated and labor intensive and were only able to be completed at a high cost with significant downtime which reduced overall productivity. These considerations necessitated the selection of heavy gauge materials of relatively high weight for basket construction. This meant that a greater proportion of the crane's lifting capacity was used for the equipment and less was used to lift overburden. Hence, operating efficiencies were adversely affected.

In contrast, the assembly of the dragline bucket 10 of the present invention requires no welding or riveting. The absence of permanent (welding) or semi-permanent (riveting) joints permits the easy and efficient separation of the forward ring 12 from the basket 14 for damage repair or replacement. As a result, the repair/replacement procedure is less complicated and less labor intensive. It may be completed at a significantly lower cost in a far shorter period of time. Accordingly, downtime is reduced and overall productivity is increased. Further, since repair/replacement is simplified, it is now feasible to construct the basket from lighter weight material as it is no longer necessary to maximize the time between repair/replacement procedures. This results in a more light weight bucket which effectively preserves the lifting capacity of the crane for the displacement of overburden. Thus, more overburden may be moved with each pass of the bucket and further increases in operating efficiency are achieved.

To release the basket 14, the releasable fasteners 44*a*, 46*b* and 46*a*, 46*b* are simply removed from the respective apertures 31, 41 and 29, 40. After adjusting the chains accordingly, the front ring 12 is simply lifted from the basket 14. Either component may then be replaced or taken from the excavation site for repairs. As should be appreciated, the ease and simplicity of separation results in a great advantage over the prior art unitary dragline buckets.

The foregoing description of a preferred embodiment of the dragline bucket of the present invention is presented for purposes of illustration and description. It is not intended to be exhaustive or to limit the invention to the precise form disclosed. Obvious modifications or variations are possible in light of the above teachings. For example, the trunnion brackets 42 could be secured to the inside face of the sidewalls 34 and/or the rear wall 36 could be cut down to a reduced height. The embodiment shown is selected and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A dragline bucket, comprising:

a basket having sidewalls;

a forward ring having means for receiving the sidewalls of said basket; and means for releasably securing said sidewalls of said basket in said sidewall receiving means, whereby said releasable securing means allows for the quick attachment and detachment of said basket to said forward ring.

2. A dragline bucket, comprising:

a basket including a lower wall, a rear wall, and a pair of opposed sidewalls, each of said sidewalls having at least one aperture formed in a peripheral margin thereof;

a forward ring having first and second cheek plates, each of said cheek plates carrying at least one pair of cooperating mounting lugs having apertures for aligning over and registering with said apertures formed in said sidewalls of said basket; and a releasable fastener for insertion through said registering apertures;

whereby said basket is releasably secured to said forward ring to allow for quick attachment or detachment.

3. A dragline bucket, comprising:

a forward ring including an arch, a first cheek plate, a second cheek plate and a bottom wall carrying excavation teeth;

a basket including a first sidewall, a second sidewall and a lower wall for receiving and holding earth;

said dragline bucket being characterized by;

a first pair of cooperating mounting lugs carried on said first cheek plate, said first pair of cooperating mounting lugs defining a first channel for receiving a first portion of said first sidewall of said basket;

a second pair of cooperating mounting lugs carried on said second cheek plate, said second pair of cooperating mounting lugs defining a second channel for receiving a second portion of said second sidewall of said basket;

a first releasable fastener for securing said first portion of said first sidewall in said first channel; and a second releasable fastener for securing said second portion of said second sidewall in said second channel.

4. The dragline bucket of claim 3, further including:

a third pair of cooperating mounting lugs carried on said first cheek plate, said third pair of cooperating mounting lugs defining a third channel for receiving a third portion of said first sidewall of said basket;

a fourth pair of cooperating mounting lugs carried on said second cheek plate, said fourth pair of cooperating mounting lugs defining a fourth channel for receiving a fourth portion of said second sidewall of said basket;

a third releasable fastener for securing said third portion of said first sidewall in said third channel; and a fourth releasable fastener for securing said fourth portion of said second sidewall in said fourth channel.

5. The dragline bucket of claim 4, further including;

a fifth pair of cooperating mounting lugs carried on said first cheek plate, said fifth pair of cooperating mounting lugs defining a fifth portion of said first sidewall of said basket;

a sixth pair of cooperating mounting lugs carried on said second cheek plate, said sixth pair of cooperating mounting lugs defining a sixth channel for receiving a sixth portion of said second sidewall of said basket;

a fifth releasable fastener for securing said fifth portion of said first sidewall in said fifth channel; and a sixth releasable fastener for securing said sixth portion of said second sidewall in said sixth channel.

6. The dragline bucket of claim 5, further including a projecting mounting lip carried on said bottom wall of said forward ring for engaging a margin of said lower wall of said basket and a first series of releasable fasteners for securing said projecting mounting lip and said margin of said lower wall together in a lapping relationship.

7. The dragline bucket of claim 3, further including a projecting mounting lip carried on said bottom wall of said forward ring for engaging a margin of said lower wall of said basket and a first series of releasable fasteners for securing said projecting mounting lip and said margin of said lower wall together in lapping relationship.

8. The dragline bucket of claim 6, wherein said margin and said first, second, third, fourth, fifth and sixth portions of said sidewalls are reinforced.

9. The dragline bucket of claim 8, wherein said first, second, third, fourth, fifth and sixth releasable fasteners are steel pins received in cooperating aligned apertures formed in said first, second, third, fourth, fifth and sixth pairs of cooperating mounting lugs and said first, second, third, fourth, fifth and sixth portions of said sidewalls.

10. The dragline bucket of claim 9, wherein said first series of releasable fasteners are multiple cooperating nuts and bolts which are received in a series of aligned cooperating apertures formed in said projecting mounting lip and said margin of said lower wall.

11. A forward ring for a dragline bucket, including an earth receiving basket comprising:

an arch, a first cheek plate, a second cheek plate and a bottom wall carrying excavation teeth;

said forward ring being characterized by:

a first pair of cooperating mounting lugs carried on said first cheek plate that define a first channel for receiving a first portion of the basket;

a second pair of cooperating mounting lugs carried on said second cheek plate that define a second channel for receiving a second portion of the basket;

a first releasable fastener for securing said first pair of cooperating mounting lugs to the basket; and a second releasable fastener for securing said second pair of cooperating mounting lugs to the basket.

12. The forward ring of claim 11, further including a mounting lip projecting from said bottom wall for engaging a lower wall of the basket and a first series of releasable fasteners for securing said projecting mounting lip to said lower wall.

13. A method for improving the operating efficiency of a dragline incorporating a bucket for winning material from the earth, the method comprising:

fitting a forward ring of said bucket with a relatively lightweight and disposable basket for receiving and carrying won material;

securing said basket to said forward ring with quick connect fasteners that may be relatively easily removed to allow said basket to be replaced; and reducing the overall weight of said bucket by using relatively lightweight materials in construction of said basket whereby a larger percentage of the lifting capacity of said dragline may be used to lift material won during mining.

* * * * *